US007988021B2

(12) United States Patent
Rossignol

(10) Patent No.: US 7,988,021 B2
(45) Date of Patent: Aug. 2, 2011

(54) SLIDING-JACKET PUMP

(75) Inventor: Eric Rossignol, Chalon-sur-saone (FR)

(73) Assignee: Rexam Dispensing SMT S.A. (FR)

( * ) Notice: Subject to any disclaimer, the term of this patent is extended or adjusted under 35 U.S.C. 154(b) by 495 days.

(21) Appl. No.: 12/136,980

(22) Filed: Jun. 11, 2008

(65) Prior Publication Data

US 2008/0237267 A1 Oct. 2, 2008

Related U.S. Application Data

(63) Continuation of application No. PCT/FR2006/002479, filed on Nov. 7, 2006.

(30) Foreign Application Priority Data

Dec. 14, 2005 (FR) ..... 05 53876

(51) Int. Cl.
*B65D 88/54* (2006.01)

(52) U.S. Cl. ..... 222/321.7; 222/321.3; 222/321.9; 222/340; 222/380

(58) Field of Classification Search ..... 222/321.7, 222/380, 321.9, 340, 321.3, 321.1, 321.8, 222/383.1; 239/333
See application file for complete search history.

(56) References Cited

U.S. PATENT DOCUMENTS

| | | | | |
|---|---|---|---|---|
| 4,183,449 | A * | 1/1980 | Blake | 222/321.2 |
| 4,315,531 | A * | 2/1982 | Gerhard | 141/98 |
| 4,371,097 | A * | 2/1983 | O'Neill | 222/321.7 |
| 4,402,432 | A * | 9/1983 | Corsette | 222/321.2 |
| 4,511,065 | A * | 4/1985 | Corsette | 222/153.13 |
| 4,640,443 | A * | 2/1987 | Corsette | 222/321.3 |
| 5,429,275 | A * | 7/1995 | Katz | 222/108 |
| 5,617,976 | A * | 4/1997 | Gueret | 222/380 |
| 6,161,732 | A * | 12/2000 | Albini | 222/321.3 |
| 6,966,465 | B2 * | 11/2005 | Kang | 222/321.9 |
| 7,048,155 | B2 * | 5/2006 | Kuwahara et al. | 222/321.9 |
| 7,182,225 | B2 * | 2/2007 | Garcia et al. | 222/321.3 |
| 7,654,419 | B2 * | 2/2010 | Dobbs et al. | 222/321.9 |
| 7,677,415 | B2 * | 3/2010 | Auer | 222/207 |
| 7,789,274 | B2 * | 9/2010 | Garcia | 222/321.7 |
| 2005/0133535 | A1 | 6/2005 | Garcia | |

FOREIGN PATENT DOCUMENTS

WO 2004054723 A1 7/2004

OTHER PUBLICATIONS

International Search Report, Mar. 15, 2007, 2 pages.

* cited by examiner

*Primary Examiner* — Frederick C. Nicolas
(74) *Attorney, Agent, or Firm* — St. Onge Steward Johnston & Reens LLC

(57) ABSTRACT

A pump for a liquid cosmetic product dispenser including a body defining a metering chamber provided with an admission orifice at the bottom and having an opening at the top into which is inserted a sleeve carried by an axially movable operating head which is provided with a delivery duct and an open/close element and is acted upon by a return spring mounted on the outside of the body. The body encloses a jacket that moves axially inside the chamber and at least partly inside the sleeve and supports a lower valve for closing the admission orifice.

11 Claims, 6 Drawing Sheets

SLIDING-JACKET PUMP

CROSS-REFERENCE TO RELATED APPLICATIONS

The present application is a continuation of pending International patent application PCT/FR2006/002479 filed on Nov. 7, 2006 which designates the United States and claims priority from French patent application 0553876 filed on Dec. 14, 2005, the content of which is incorporated herein by reference.

FIELD OF THE INVENTION

The present invention relates to a pump which is intended more particularly for metering and dispensing liquid cosmetic products such as creams or gels.

BACKGROUND OF THE INVENTION

The known pumps which are used in this type of application generally comprise a body which delimits a metering chamber provided in the lower part with an intake orifice and having in the upper part an opening into which there is introduced a sleeve borne by an axially displaceable actuation head which is provided with a discharge conduit and with a closure element and which moreover cooperates with a return spring mounted on the exterior of said body.

This arrangement makes it possible to prevent the spring, which is made of metal, from entering into contact with the product and giving rise to physico-chemical degradation phenomena.

The displacement of the actuation head relative to the body has a piston effect which causes the product inside the chamber to be compressed and to exit via the discharge conduit.

The intake orifice is for its part able to be closed off, at least during the phase of dispensing the product, by a valve which is generally a ball valve.

However, this valve is independent of the other constituent elements of the pump and is made in the form of parts which are attached to the body, which creates problems with regard to sealing, coordination during operation and assembly difficulties.

Furthermore, such a valve is subject to the forces of gravity and may fail to operate in the case when the pump is used in the inclined or inverted position.

SUMMARY OF THE INVENTION

The object of the present invention is to solve these technical problems satisfactorily.

This object is achieved according to the invention by means of a pump of the aforementioned type, characterised in that the body encloses a jacket which can be displaced axially in said chamber and at least partially inside the sleeve and which bears a lower valve capable of closing the intake orifice.

According to one advantageous feature, said jacket comprises, in the lower part, a sealing skirt which is in contact with the inner wall of the chamber.

According to another feature, said jacket comprises, in the upper part, a peripheral lip which is in sealed frictional contact with the inner wall of the sleeve.

Advantageously, said jacket comprises a peripheral shoulder capable of coming into abutment against an annular protrusion borne by the inner wall of the body in order to limit its upward travel.

According to one variant, said valve comprises a central cup connected to the wall of said jacket by radial fins.

Preferably, said cup has a cross section complementary to that of the intake orifice.

According to another variant, the body comprises a vent orifice which opens, in the lower part, into the chamber and is able to communicate with an annular atmospheric compartment formed at the periphery of the jacket.

Advantageously, said vent orifice can be isolated in a sealed manner from the atmospheric compartment by an annular flap borne by the lower part of the jacket.

Preferably, said flap and said skirt delimit between them a peripheral groove which covers a circular rib borne by the bottom of the chamber.

According to one variant, said closure element for closing the discharge conduit is associated with a control rod which can move axially in said jacket.

In this case, it is provided that said jacket comprises an upper collar for guiding the control rod.

It is also possible to provide that the inner wall of said jacket is provided with a rim for axially retaining the control rod.

According to another feature, the body is made in a single piece with a ring for fixing the pump to the neck of a container.

The pump of the invention has a simple structure which is inexpensive to produce and ensures a high level of sealing for the product.

It also makes it possible to ensure a reliable way of dispensing the product with a precise and reproducible dose and offers a high degree of adaptability and cooperation with different variants of actuation heads with end closures.

The pump of the invention applies both to an atmospheric dispenser and to an airless dispenser.

In an atmospheric application, the air return takes place in an original manner which presents all the necessary guarantees with regard to sealing and regularity.

In an airless application, and depending on the type of container used, the pump may not comprise a vent orifice.

BRIEF DESCRIPTION OF THE DRAWINGS

Other objects and advantages of the invention will emerge in the course of the following description, which is given with reference to the appended drawings, in which.

DETAILED DESCRIPTION OF THE INVENTION

Figure 1:
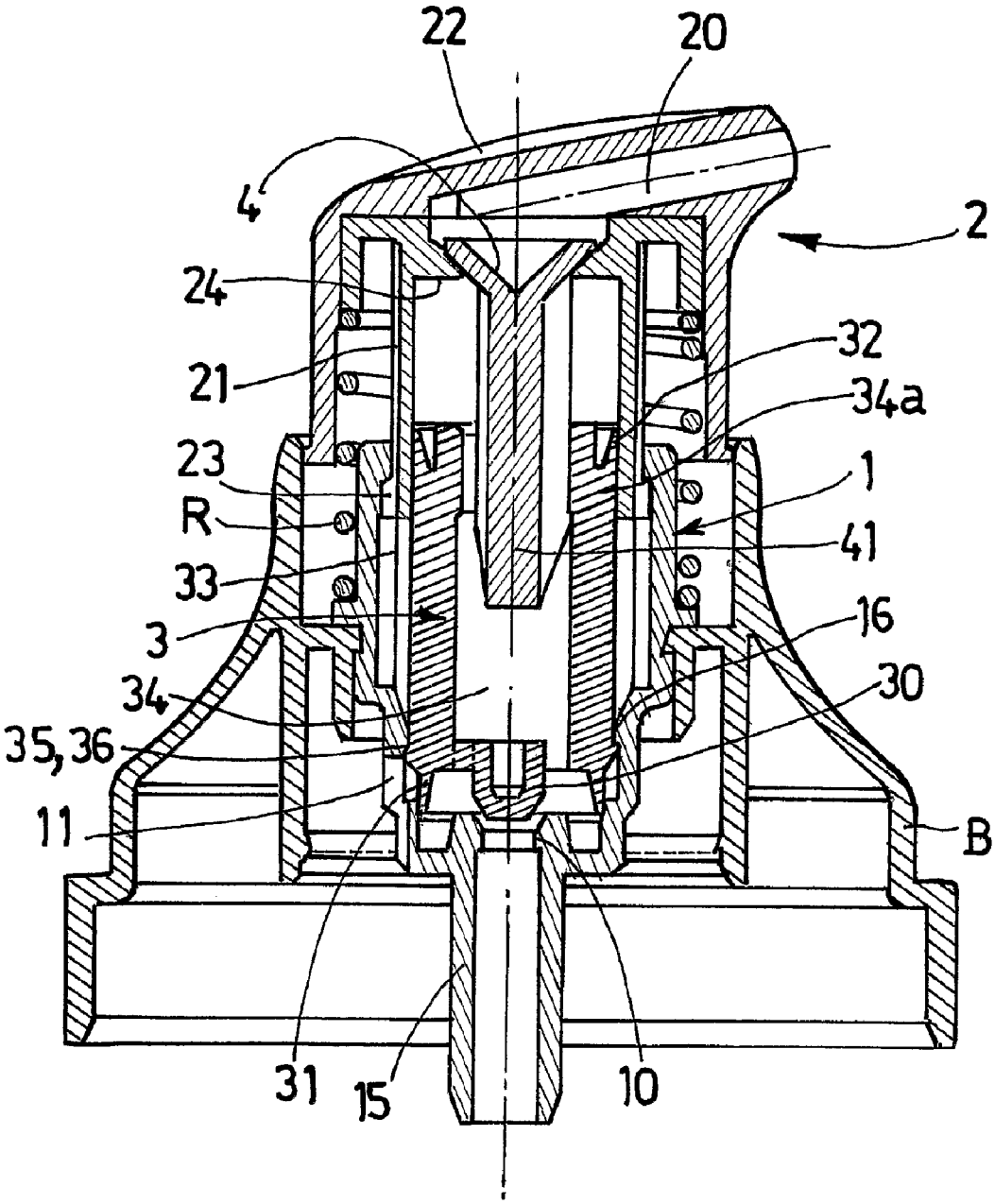
FIG. 1 shows a sectional view of a first embodiment of the pump of the invention.
Figure 2:
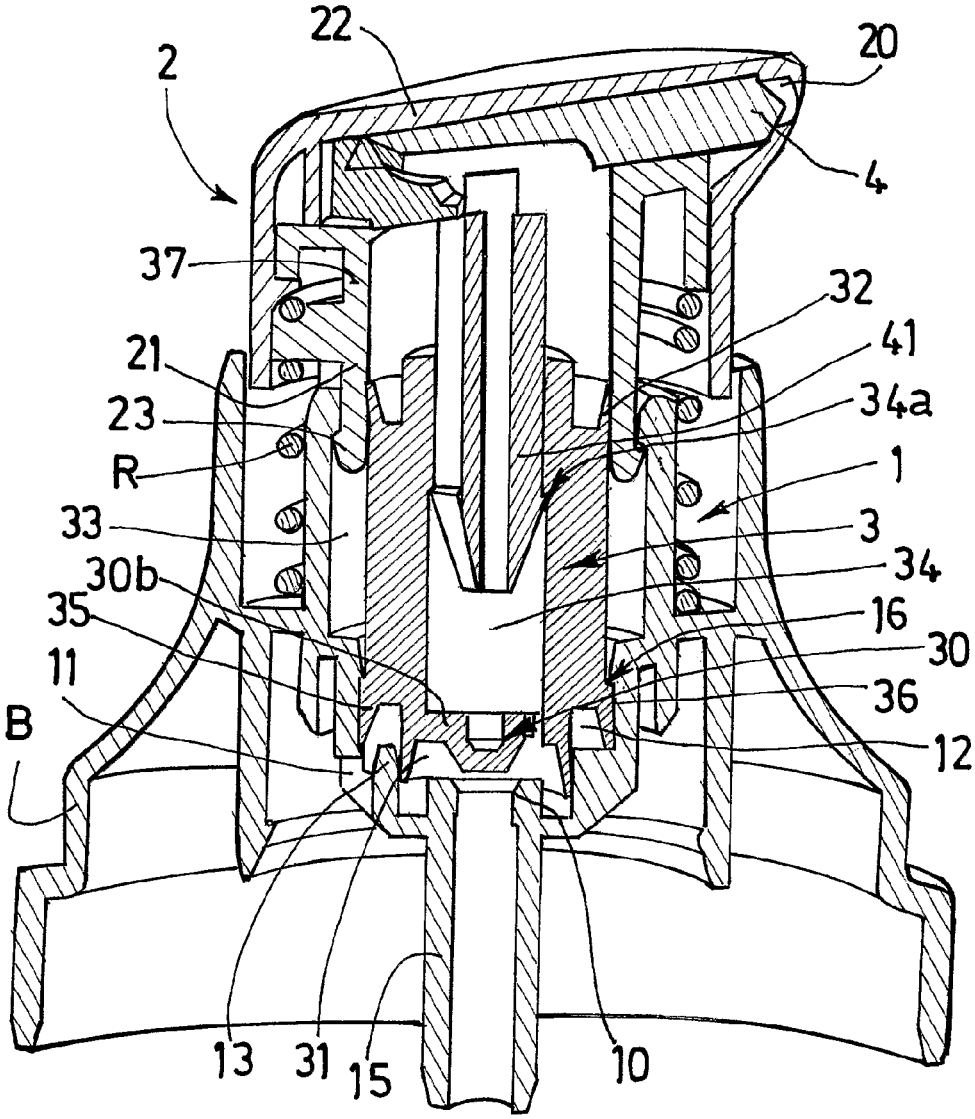
FIG. 2 shows a sectional view of a second embodiment of the pump of the invention.

The pump of the invention comprises, as shown in FIGS. 1 and 2, a generally cylindrical body 1, the wall of which delimits internally a metering chamber.

In the embodiment of FIG. 1, the body 1 is mounted in a ring B which is designed to be fixed to the neck of a product reservoir which is in the form of a bottle or more generally a cylindrical container (not shown).

In the variant of FIG. 2, the ring B is made in a single piece with the body 1.

The metering chamber of the pump is provided, in the lower part, with an intake orifice 10 which is extended downwards into the reservoir by an intake tube 15. The chamber has, in the upper part, an opening into which there is introduced a sleeve 21 borne by an actuation head 2.

The head 2 forms an axially displaceable push-button, and the sleeve 21 is covered by a shrunk-fit section or cap 22.

The lower perimeter of the sleeve 21 is provided with radial retaining protrusions 23 which cooperate with an upper collar 14 of the body 1 so as to prevent the separation of the pump and its head 2.

A manual push by the user on the upper face of the cap 22 of the head 2 causes the latter to descend, while its return to the top position is brought about by a return spring R mounted coaxially outside the body 1 and the sleeve 21.

The head 2 is moreover provided with a conduit 20 for discharging the product, said conduit being supplied at the upstream end by the metering chamber and opening to the outside at the downstream end.

The conduit 20 is provided with a closure element 4, for example in the form of a valve which is arranged at the upstream end in the embodiment of FIG. 1 and is arranged at the downstream end of said conduit in the embodiment of FIG. 2.

According to the invention, the body 1 encloses a cylindrical jacket 3 which can be displaced axially in the chamber and at least partially inside the sleeve 21 and bears a lower valve 30 capable of closing off the intake orifice 10.

The jacket 3 also comprises, in the lower part, a sealing skirt 31 which is in contact with the inner wall of the chamber.

In FIG. 2, the bottom of the chamber bears a circular rib 13 which extends around the orifice 10 and against the inner face of which the lower edge of the skirt 31 bears in a sealing manner.

In the upper part, the jacket 3 comprises a peripheral lip 32 which is in sealed frictional contact with the inner wall of the sleeve 21 and which, as it slides, also performs scraping of the product.

The internal volume of the jacket 3 and that of the sleeve 21 up to the entrance of the discharge conduit 20 constitutes the volume of one dose of product.

Figure 4A:
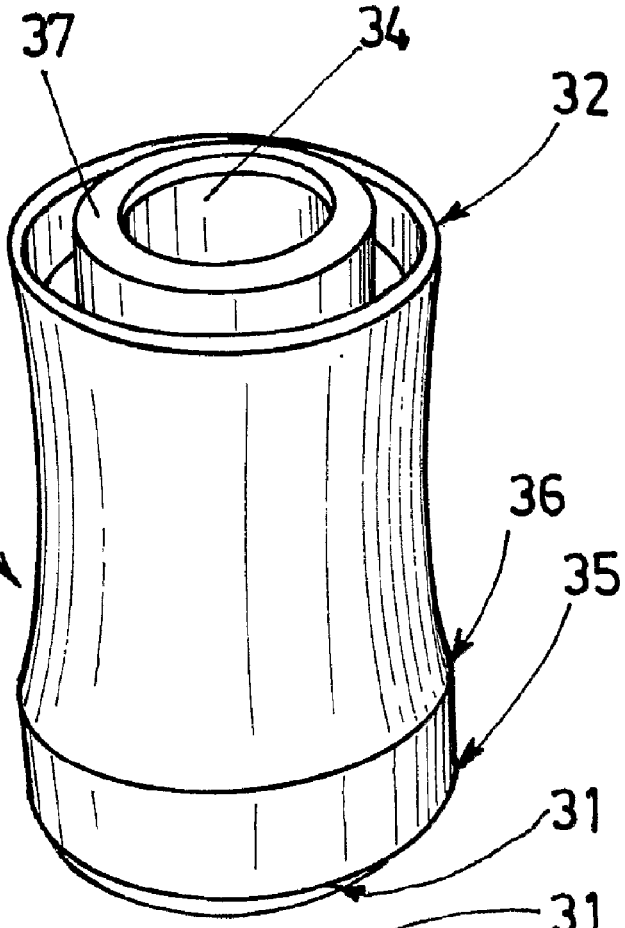
FIGS. 4A and 4B show partial perspective views, respectively from above and from below, of the embodiment of FIGS. 1 and 2.
Figure 4B:
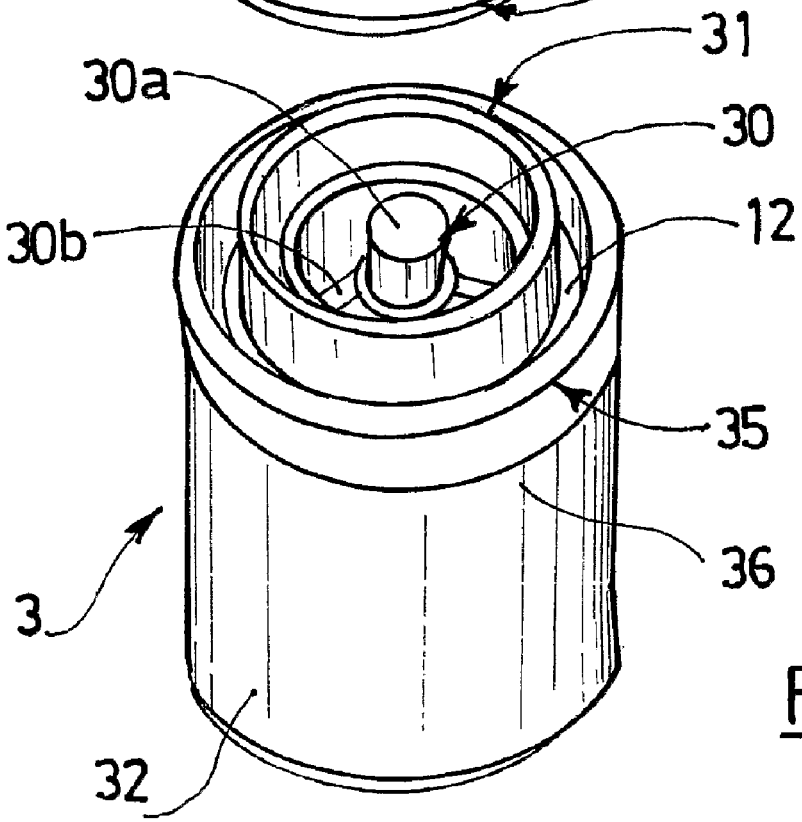

The intake valve 30 comprises a central cup 30*a* connected to the wall of the jacket 3 by a set of radial fins 30*b*, as shown in FIG. 4B. The cup 30*a* preferably has a cross section complementary to that of the intake orifice 10 and has for example here a frustoconical shape or else, according to a variant which is not shown, a spherical shape.

In the case of atmospheric applications, such as for the embodiments of FIGS. 1 and 2, the body 1 of the pump comprises a vent orifice 11 which opens, in the lower part, into the chamber and is able to communicate with an annular compartment 33 formed at the periphery of the jacket 3 between its outer wall and the inner wall of the body 1.

The vent orifice 11 can be isolated in a sealed manner from the compartment 33, in particular when the pump is at rest and during the phase of delivering the product, by an annular flap 35 borne by the lower part of the jacket 3, as shown in FIGS. 4A and 4B.

In the embodiment of FIG. 2, the flap 35 and the sealing skirt 31 delimit between them a peripheral groove 12 which covers the circular rib 13 of the bottom of the chamber.

The jacket 3 comprises a peripheral shoulder 36 capable of coming into sealed abutment against an annular protrusion 16 borne by the inner wall of the body in order to limit the upward travel of said jacket (see FIGS. 2, 4A and 4B).

In the embodiment of FIG. 2, the area between the lower end of the flap 35 and the shoulder 36 ensures the axial orientation of the jacket 3 in the chamber.

In the embodiment of FIG. 1, the flap is very short and it is therefore its upper face which delimits the shoulder 36.

In the two embodiments of FIGS. 1 and 2, the closure element 4 is associated with a control rod 41 which can move axially in the jacket 3. However, other types of valve would also be suitable, such as a spring valve for example.

In the embodiment of FIG. 1, the closure element 4 is a valve, the seat of which is formed by a frustoconical area formed in the upper part of the sleeve 21 and which moreover forms a shoulder forming an upper stop for the jacket 3.

In the embodiment of FIG. 2, the closure element 4 is a retractable needle valve 42 in the conduit 20.

The jacket 3 comprises an upper collar 37 for guiding the rod 41, and the latter has a diameter smaller than the inner diameter of the central bore 34 of the jacket 3 so as to allow the passage of the product being dispensed.

According to one variant, the passage of the product may also be provided via longitudinal grooves formed on the rod 41.

However, the inner wall of the jacket 3 is provided with a rim 34*a* for axially retaining the end of the rod 41 which has a chamfered cross section in FIG. 2.

FIGS. 3A to 3F illustrate the successive phases of delivering the product with the pump of the invention in the atmospheric version according to the variant of FIG. 1. For the sake of clarity, the liquid product is not shown in these figures.

Figure 3B:
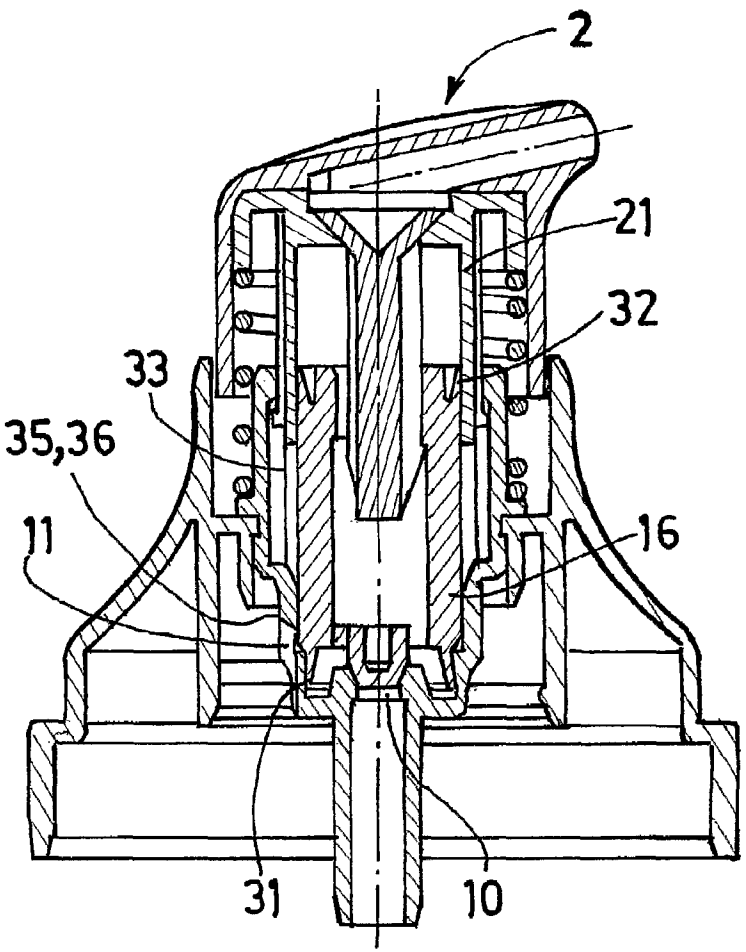
FIGS. 3A to 3F show schematic views of the various phases of delivering the product with a pump according to the embodiment of FIG. 1.
Figure 3A:
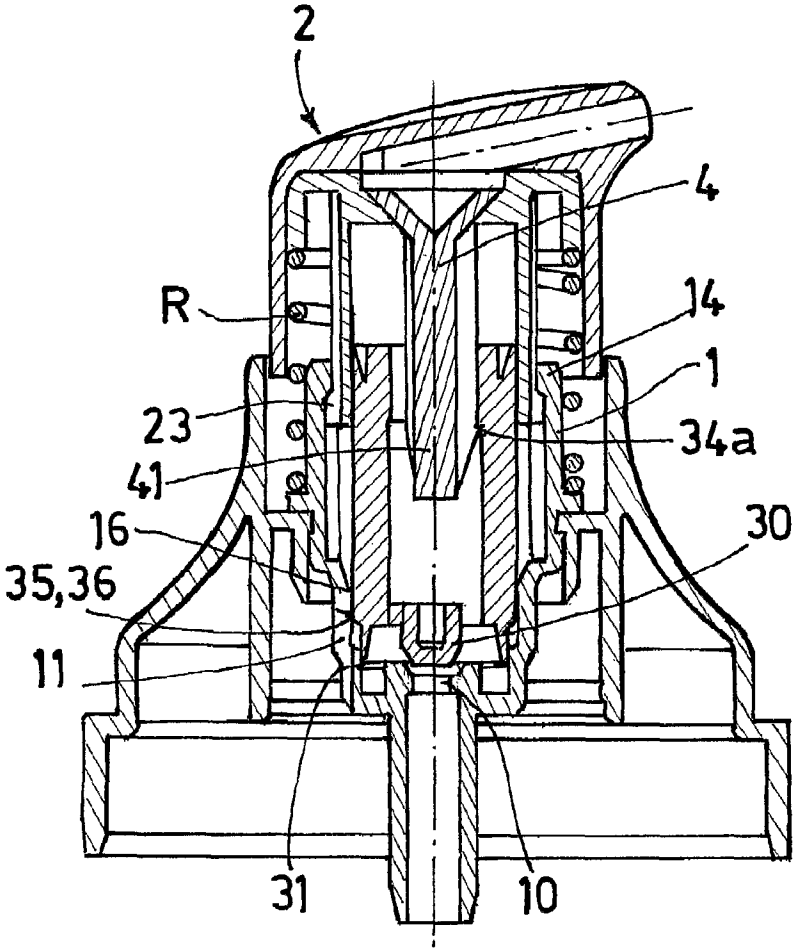

The position shown in FIG. 3A corresponds to the rest position of the pump.

In this position, the chamber is filled with product and, due to the abutment of the protrusion 23 against the collar 14, the spring R remains slightly compressed so as to keep the head 2 towards the top and consequently to keep the closure element 4 bearing in a sealed manner against its seat.

The sealing effect is reinforced by the fact that the end of the rod 41 of the element 4 is drawn downwards due to the fact that it is hooked onto the rim 34*a*.

The jacket 3 is in the upper position here and the intake valve 30 is open.

The peripheral shoulder 36 bears in a sealed manner against the lower face of the annular protrusion 16, thus preventing any exchange between the interior of the container and the exterior.

The position shown in FIG. 3B corresponds to the start of the phase of pressing down on the head 2, the force of which is illustrated by an axial arrow.

The frictional contact between the lip 32 of the jacket 3 and the inner wall of the sleeve 21 keeps together the assembly consisting of the two parts and the closure element 4 in their joint descending movement.

The slight hold resulting from this contact nevertheless provides a resistance greater than the hold between the skirt 31 and the wall of the body 1.

Following this movement, the valve 30 closes the intake orifice 10 and thus prevents the product contained in the chamber from returning to the container.

In parallel, the flap 35 clears the vent orifice 11 and thus allows it to communicate with the annular compartment 33, which is itself in communication with the exterior.

Figure 3D:
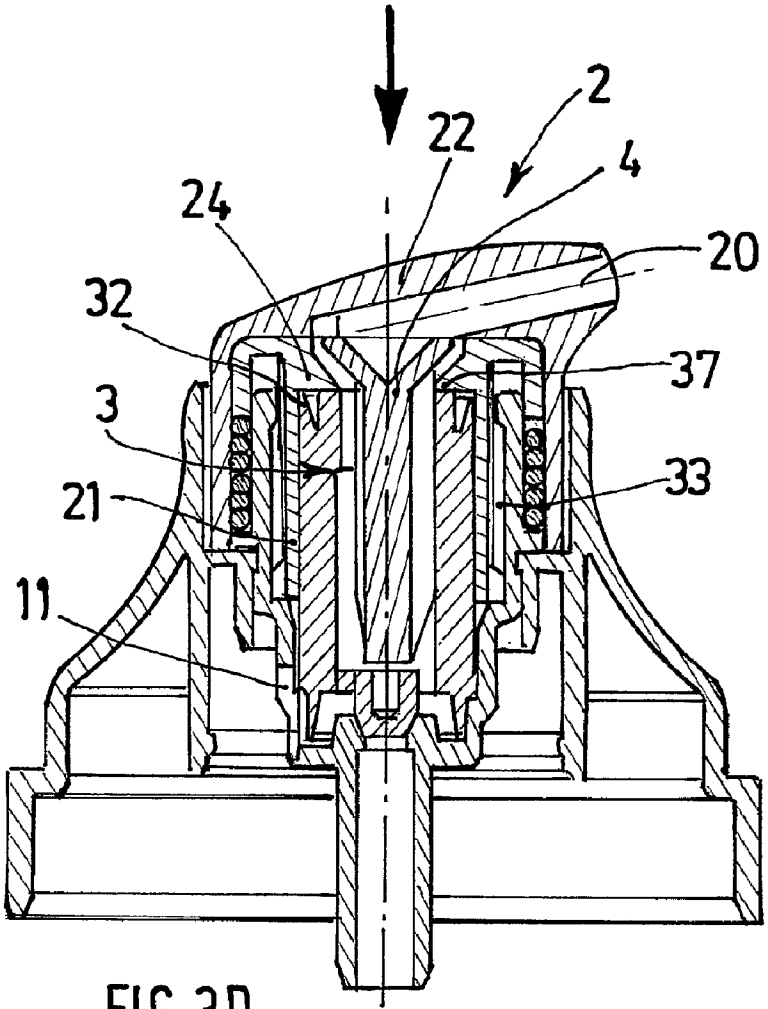
Figure 3C:
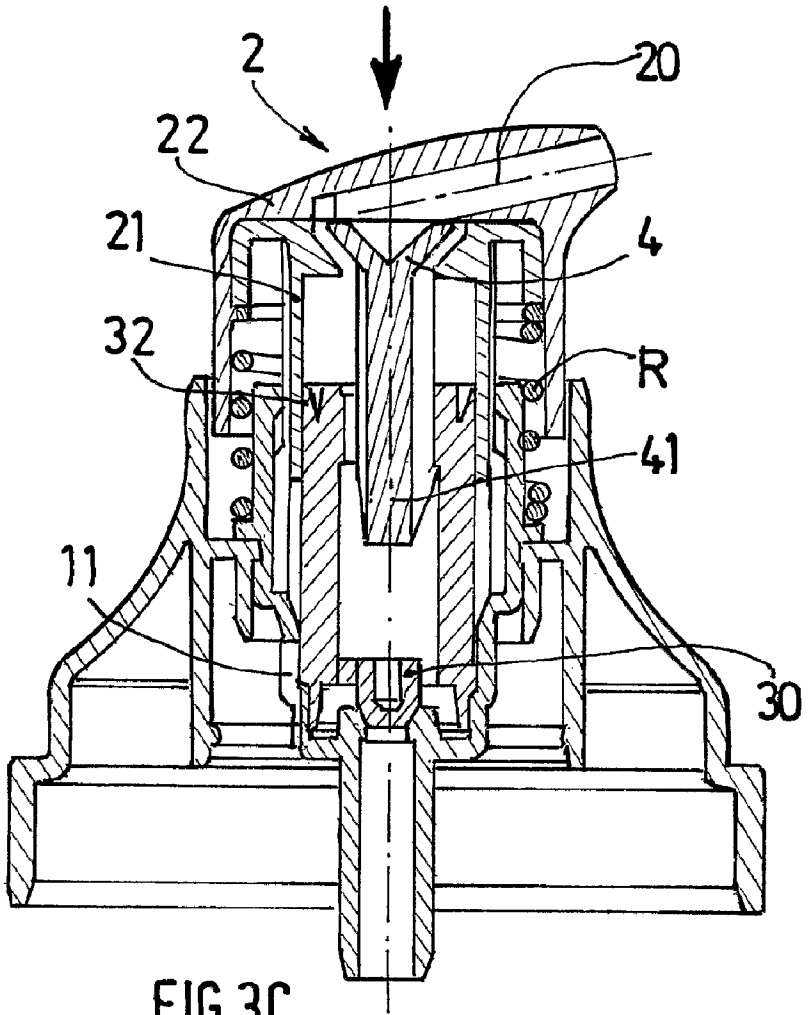

In FIG. 3C, the user continues to press down and the head 2 thus continues its descent, while the jacket 3 bears against the bottom of the chamber.

The frictional resistance of the contact between the jacket 3 and sleeve 21 is overcome and gives way to a sliding motion which scrapes the lip 32 against the inner wall of the sleeve while the latter continues its downward travel.

This movement causes the compression of the product in the chamber in the manner of a piston and causes the closure element 4 to come away from its seat so as to liberate the product which thus starts to escape through the conduit 20.

In FIG. 3D, while the user continues to push down, the closure element 4 is pressed in the open position at the top against the inner wall of the conduit 20 and/or the cap 22.

The sleeve 21 continues its downward travel while compressing the product in the chamber until the upper edge of the jacket 3 (lip 32 or collar 37) comes into abutment against a shoulder 24 of the head.

At this moment from the chamber, a volume corresponding to one dose of product has been delivered to the user and the dispensing phase is terminated.

The vent orifice 11 communicates with the compartment 33, which allows the product reservoir (not shown) to reach atmospheric pressure and allows an equalisation of the pressures.

Figure 3F:
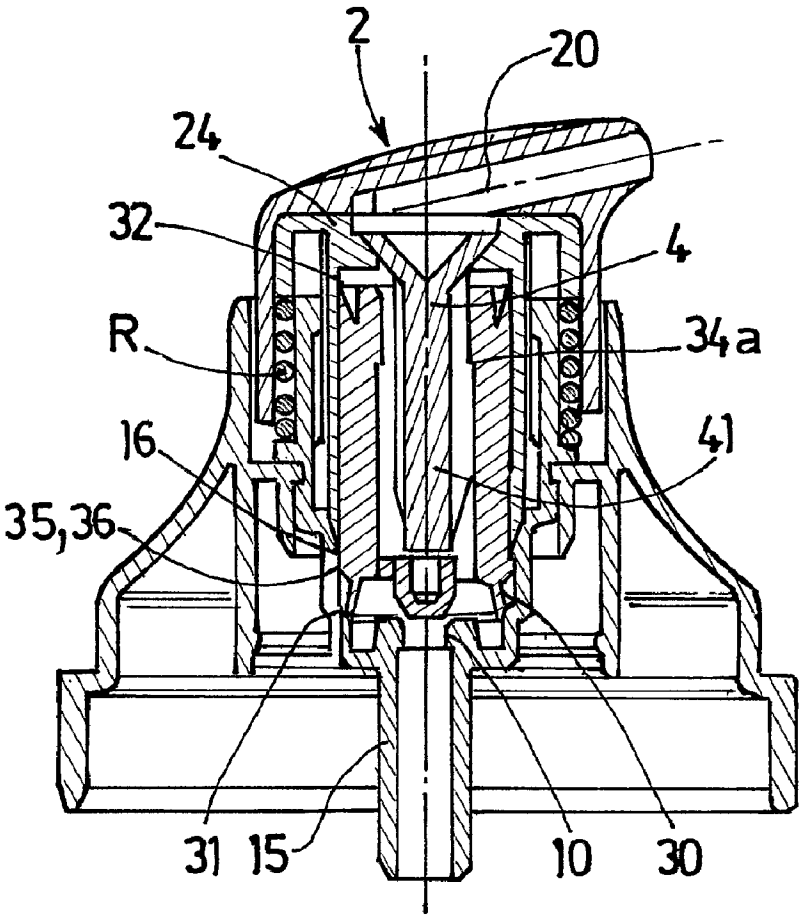
Figure 3E:
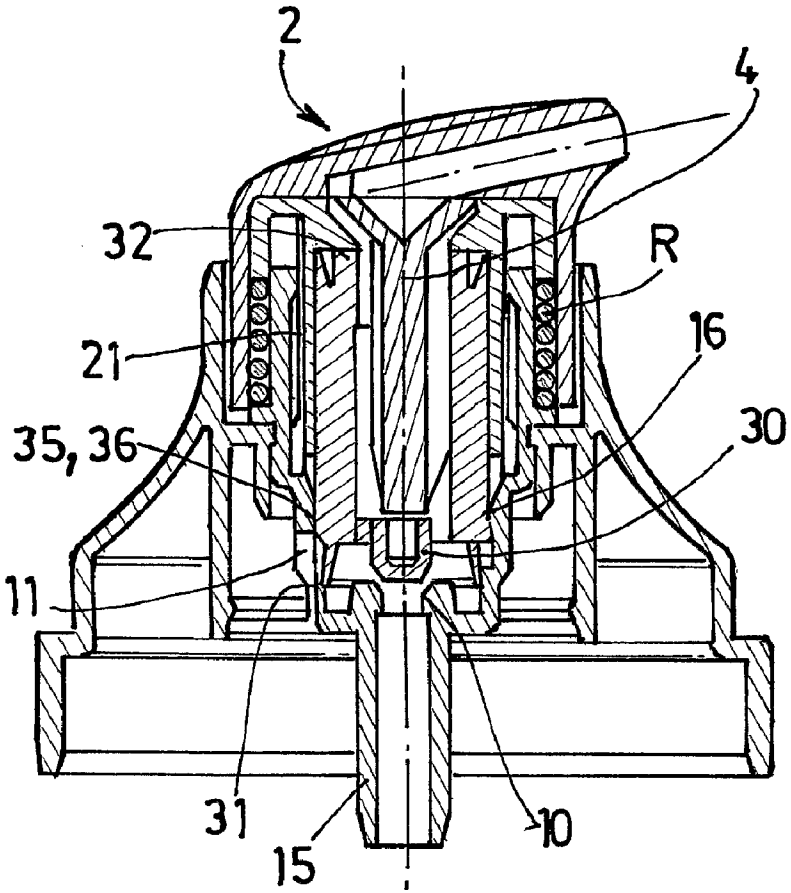

The user then releases the pressure and the spring R returns the head 2 to the top as shown in FIG. 3E.

Due to the frictional contact between the lip 32 and the wall of the sleeve 21, the jacket 3 and the head 2 initially ascend together with the valve 30 which leads to the opening of the intake orifice 10.

The vacuum created in the body of the pump as a result of this displacement causes product to be sucked into the reservoir via the intake tube 15 and causes the gradual filling of the metering chamber.

At the same time, the vent orifice 11 is closed as a result of the flap 35 again coming into contact with the inner wall of the body until its upper face forming the shoulder 36 comes into abutment against the protrusion 16 of the body.

Very quickly, however, the resistance of the lip 32 is overcome and the sleeve 21 continues its upward travel independently of the jacket 3 which remains blocked in the bottom position by the stop 16 of the body.

The closure element 4 then returns to its sealing position and thus closes the conduit 20 as shown in FIG. 3F, and during this phase the chamber continues to fill with product.

Still under the action of the spring R, the head 2 continues its upward travel and finally stops in the rest position of FIG. 3A to await a new dispensing phase.

In this latter position, the conduit 20 is kept in a sealed closed position due to the action of the spring R and the fact that the rod 41 of the element 4 is drawn downwards by the rim 34*a*.

Of course, this pump may also be produced without a vent orifice in the case of an airless use.

What is claimed is:

1. A pump for a liquid cosmetic product dispenser, comprising a body which delimits a metering chamber provided in a lower part with an intake orifice and having in an upper part an opening into which there is introduced a sleeve borne by an axially displaceable actuation head which is provided with a discharge conduit and with a closure element and which cooperates with a return spring mounted on the exterior, said body enclosing a jacket which can be displaced axially in said chamber and at least partially inside the sleeve and which bears a lower valve capable of closing the intake orifice, characterised in that said closure element for closing the discharge conduit is associated with a control rod which can move axially in said jacket, characterised in that said jacket comprises, in the lower part, a sealing skirt which is in contact with an inner wall of the chamber.

2. The pump according to claim 1, characterised in that said jacket comprises, in the upper part, a peripheral lip which is in sealed frictional contact with the inner wall of the sleeve.

3. The pump according to claim 1, characterised in that said jacket comprises an upper collar for guiding the control rod.

4. The pump according to claim 1, characterised in that the body is made in a single piece with a ring for fixing it to the neck of a container.

5. The pump according to claim 1, characterised in that said jacket comprises, in the upper part, a peripheral lip which is in sealed frictional contact with the inner wall of the sleeve.

6. A pump for a liquid cosmetic product dispenser, comprising a body which delimits a metering chamber provided in a lower part with an intake orifice and having in an upper part an opening into which there is introduced a sleeve borne by an axially displaceable actuation head which is provided with a discharge conduit and with a closure element and which cooperates with a return spring mounted on the exterior, said body enclosing a jacket which can be displaced axially in said chamber and at least partially inside the sleeve and which bears a lower valve capable of closing the intake orifice, characterised in that said closure element for closing the discharge conduit is associated with a control rod which can move axially in said jacket, characterised in that said jacket comprises a peripheral shoulder capable of coming into abutment against an annular protrusion borne by an inner wall of the body in order to limit its upward travel.

7. A pump for a liquid cosmetic product dispenser, comprising a body which delimits a metering chamber provided in a lower part with an intake orifice and having in an upper part an opening into which there is introduced a sleeve borne by an axially displaceable actuation head which is provided with a discharge conduit and with a closure element and which cooperates with a return spring mounted on the exterior, said body enclosing a jacket which can be displaced axially in said chamber and at least partially inside the sleeve and which bears a lower valve capable of closing the intake orifice, characterised in that said closure element for closing the discharge conduit is associated with a control rod which can move axially in said jacket, characterised in that said valve comprises a central cup connected to a wall of said jacket by radial fins.

8. The pump according to claim 7, characterised in that said cup has a cross section complementary to that of the intake orifice.

9. A pump for a liquid cosmetic product dispenser, comprising a body which delimits a metering chamber provided in a lower part with an intake orifice and having in an upper part an opening into which there is introduced a sleeve borne by an axially displaceable actuation head which is provided with a discharge conduit and with a closure element and which cooperates with a return spring mounted on the exterior, said body enclosing a jacket which can be displaced axially in said chamber and at least partially inside the sleeve and which bears a lower valve capable of closing the intake orifice, characterised in that said closure element for closing the discharge conduit is associated with a control rod which can move axially in said jacket, characterised in that the body comprises a vent orifice which opens, in the lower part, into the chamber and is able to communicate with an annular atmospheric compartment formed at the periphery of the jacket, and characterised in that said vent orifice can be isolated in a sealed manner from the atmospheric compartment by an annular flap borne by the lower part of the jacket.

10. The pump according to claim 9, characterised in that said jacket comprises, in the lower part, a sealing skirt which is in contact with an inner wall of the chamber, and said flap and said skirt delimit between them a peripheral groove which covers a circular rib borne by the bottom of the chamber.

11. A pump for a liquid cosmetic product dispenser, comprising a body which delimits a metering chamber provided in a lower part with an intake orifice and having in an upper part an opening into which there is introduced a sleeve borne by an axially displaceable actuation head which is provided with a discharge conduit and with a closure element and which cooperates with a return spring mounted on the exterior, said body enclosing a jacket which can be displaced axially in said chamber and at least partially inside the sleeve and which bears a lower valve capable of closing the intake orifice, characterised in that said closure element for closing the discharge conduit is associated with a control rod which can move axially in said jacket, characterised in that an inner wall of said jacket is provided with a rim for axially retaining the control rod.

* * * * *